US007140140B2

(12) United States Patent
Yoshitaka

(10) Patent No.: US 7,140,140 B2
(45) Date of Patent: Nov. 28, 2006

(54) CHOKE TUBE

(75) Inventor: Ryosuke Yoshitaka, Okayama-ken (JP)

(73) Assignee: Tohoseiki Co., Inc., Okayama-ken (JP)

( * ) Notice: Subject to any disclaimer, the term of this patent is extended or adjusted under 35 U.S.C. 154(b) by 0 days.

(21) Appl. No.: 11/110,124

(22) Filed: Apr. 20, 2005

(65) Prior Publication Data

US 2006/0010750 A1 Jan. 19, 2006

(30) Foreign Application Priority Data

Apr. 21, 2004 (JP) ..... 2004-125796

(51) Int. Cl.
*F41A 21/00* (2006.01)

(52) U.S. Cl. ..... 42/79; 42/76.02

(58) Field of Classification Search ..... 42/79, 42/76.01, 76.02
See application file for complete search history.

(56) References Cited

U.S. PATENT DOCUMENTS 2,589,738 A * 3/1952 Sedberry ..... 42/79
2,828,569 A * 4/1958 Steane ..... 42/79
2,837,856 A * 6/1958 Benitez ..... 42/79
2,847,788 A * 8/1958 Twigg ..... 42/79
2,867,932 A * 1/1959 Keightley ..... 42/79
2,894,349 A * 7/1959 Hare ..... 42/79
2,922,242 A * 1/1960 Pachmayr et al. ..... 42/79
2,977,702 A * 4/1961 Schacht ..... 42/79
3,160,156 A * 12/1964 Tyler ..... 604/223
3,367,055 A * 2/1968 Powell ..... 42/79
3,769,731 A * 11/1973 Pachmayr et al. ..... 42/79
6,112,447 A * 9/2000 Androsov ..... 42/79
6,497,772 B1 * 12/2002 Meckel et al. ..... 148/254
2002/0121040 A1 * 9/2002 Kumler ..... 42/79
2005/0091901 A1 * 5/2005 Perry et al. ..... 42/78
2006/0010744 A1 * 1/2006 Schumacher ..... 42/1.01

FOREIGN PATENT DOCUMENTS

JP 08-313195 A 11/1996

OTHER PUBLICATIONS www.briley.com Briley Manufacturing Company Website Aug. 2002.*
www.wikipedia.com "Titanium nitride".*

* cited by examiner

*Primary Examiner*—Michael J. Carone
*Assistant Examiner*—Benjamin P. Lee
(74) *Attorney, Agent, or Firm*—Weingarten, Schurgin, Gagnebin & Lebovici LLP

(57) ABSTRACT

Different colors are prepared for inner shapes that define different design ballistic patterns. Wear resistant coatings of the different colors are applied over outer surfaces of tube bodies having the design ballistic patterns corresponding to the colors of the wear resistant coatings to allow the design ballistic patterns to be identified by the colors of the wear resistant coatings.

12 Claims, 2 Drawing Sheets

CHOKE TUBE

This application claims priority to a Japanese application No. 2004-125796 filed Apr. 21, 2004.

BACKGROUND OF THE INVENTION

1. Field of the Invention

The present invention relates to a choke tube attached to a muzzle of a barrel of a shotgun.

2. Description of the Related Art

A screw-in choke tube of a shotgun includes a tube body composed of carbon steel or stainless steel. A hard coating, such as a TiN film (titanium nitride film), a CrN film (chromium nitride film), a TiAlN film (titanium aluminum nitride) and a TiCN film (titanium carbide nitride film), is applied over the inner surface (the barrel) of the tube body in some proposed devises. This coating is effective to improve the wear resistance on the inner surface. Such coating for gun is, for example, disclosed in JP-A 08-313195, its title being "hunting rifle having hard film on internal surface of muzzle of its barrel".

The choke tube has a different ballistic pattern depending on the inner shape thereof. Therefore, a plurality of choke tubes having a variety of inner shapes are prepared to achieve different design ballistic patterns such that the user can select a desired design ballistic pattern.

Even if the choke tubes have different design ballistic patterns, however, they are designed to exhibit the same appearance as commodities in general. In this case, the design ballistic patterns are identified by character information, such as trade names and model numbers, described on outer surfaces. Accordingly, it is difficult for the user to simply identify the design ballistic patterns that are respectively set for the choke tubes.

This may lead to the following consideration. Namely, different colors are prepared for respective inner shapes of the choke tubes having different design ballistic patterns. The colors corresponding to the design ballistic patterns associated with the inner shapes of the choke tubes may be printed on the outer surfaces of the tube bodies. In such the case, application of colors in a post-process elevates work costs. In addition, a printing process, capable of achieving stable fixture against heat during shooting, causes an increased price as a problem.

The inventor has paid attention to colors of wear resistant coatings applied to the choke tubes, which differ depending on materials of the wear resistant coatings. In consideration of the above situation, the present invention has a subject matter to color-code outer surfaces of choke tubes based on design ballistic patterns set for the choke tubes, not depending on coloring in a post-process. In addition, the present invention has an object to identify the design ballistic patterns simply by the colors applied to the choke tubes.

SUMMARY OF THE INVENTION

The present invention has been made in consideration of such the situation and provides a choke tube having a tube inner shape for defining a design ballistic pattern. The choke tube comprises a tube body; and a wear resistant coating applied on the outer surface of the tube body. The wear resistant coating has a particular color corresponding to the tube inner shape to allow the design ballistic pattern to be identified by the outer appearance of the choke tube, thereby solving the above subject matter. A choke tube, more preferable to solve the above subject matter, further comprises a wear resistant coating applied over the inner surface of the tube body. The wear resistant coating is identical with the wear resistant coating applied on the outer surface.

In the present invention, a plurality of flat planes may be arranged in parallel over the outer circumferential surface of the tube body. The parallel-arranged flat planes are provided with diamond-like cuts to form a decorated portion around the outer circumferential surface, by which good grasping with an attachment tool can be made possible.

In the present invention, a plurality of notched recesses may be formed around the tip of the discharge orifice of the tube body at an equal interval in the circumferential direction of the discharge orifice.

In the present invention, a plurality of slits elongated along the length of the tube body may be formed through the tube wall of the tube body, close to the discharge orifice of the tube body, at an equal interval in the circumferential direction of the tube body.

In the present invention, specific colors of wear resistant coatings are prepared for respective design ballistic patterns. The wear resistant coatings are applied on outer surfaces of tube bodies to allow the design ballistic patterns to be identified by the colors of the wear resistant coatings. Accordingly, selection of coating material, which is generally carried out in a coating process, is only required to produce a choke tube of a different color corresponding to a different design ballistic pattern. As a result, the design ballistic pattern can be identified extremely easier. If the same coating is applied to both the outer surface and the inner surface of the tube body, the color indicative of the design ballistic pattern can be provided during the process step of applying the coating on the inner surface. Therefore, the manufacturing cost can not be increased. Further, any impact and heat can not peel off nor modify the wear resistant coating on the outer surface. Accordingly, a stable indication of the design ballistic pattern can be achieved. Thus, practically excellent effects can be obtained as described above.

In the present invention, a plurality of flat planes are arranged continuously over the outer circumferential surface of the tube body. The continuously arranged flat planes provide a diamond-cut decorated portion around the outer circumferential surface, which can be grasped with an attachment tool. Thus, an easily available household tool such as a spanner and a prier can be utilized for attachment and detachment of the choke tube to and from a barrel. In addition, an outward appearance can be enhanced to improve the commodity nature of the choke tube.

An impact on discharge of the firing gas through the muzzle occupies most of the impact on firing. Therefore, in the present invention, a plurality of notched recesses are formed around the tip of the discharge orifice of the tube body at an equal interval in the circumferential direction of the discharge orifice. In this case, the discharge orifice is shaped to have partially enlarged portions. Thus, the firing gas can be diffused to the surrounding through the enlarged portions of the discharge orifice. This is effective to suppress a leap of the barrel and achieve a higher hit rate.

Also in the present invention, a plurality of slits elongated along the length of the tube body are formed through the tube wall of the tube body, close to the discharge orifice of the tube body, at an equal interval in the circumferential direction of the tube body. In this case, the firing gas can be diffused to the surrounding through the slits, like in the above case. This is effective to dissipate heat on firing to prevent the temperature from elevating higher, improving the ability for prevention of deterioration of the barrel at the muzzle side even after a number of pellets are discharged successively.

DETAILED DESCRIPTION OF THE INVENTION

Figure 1:
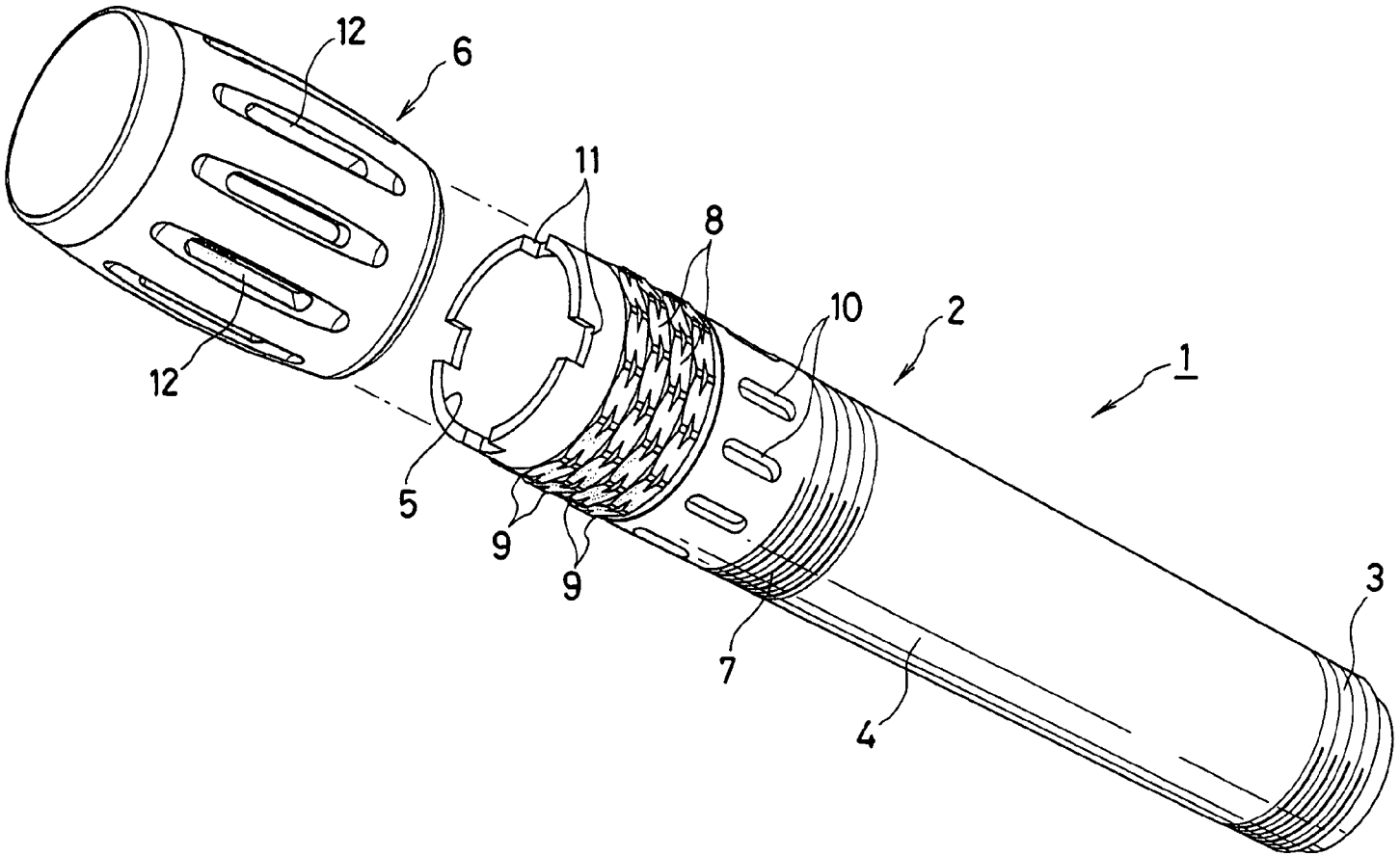
FIG. 1 is an illustrative view showing an example of the choke tube according to the present invention, which is divided into a tube body and a cover ring.

The present invention will now be described in detail based on the embodiments shown in the figures.

In the figures, the reference numeral 1 denotes a choke tube. The choke tube 1 includes a tube body 2 having an inner shape so formed as to have a choking effect based on a design ballistic pattern, and an attachment screw 3 threaded around the tube body 2 at the barrel side. The choke tube is screwed into the barrel tip of the shotgun using the attachment screw 3.

A high-hardness stainless steel (SUS630-multiaging steel) is processed at 1050° C. into a solid solution. Thereafter, it is subjected to a H900 process (in vacuum at 510° C. for 5 hours) to obtain a material having a high-hardness (HRC 45–55) matrix function, which is employed as the tube body 2. The use of such the material makes the tube body absolutely stainless. The inner circumferential surface is finished to have a surface roughness of 3.2 S or below, which enables steel pellets to smoothly slide thereon to suppress the wear on the inner circumferential surface of the tube body 2. The roundness determined 0.03 or below, in the inner diameter dimension accuracy, improves the pattern performance of pellets. The scattering pattern distance of pellets is designed by processing the inner diameter as varying in dimension slightly in the longitudinal direction of the tube body.

A wear resistant coating 4 with a thickness of 0.5 μm is applied to the choke tube 1 over the entire surface of the tube body 2 including the inner circumferential surface and the outer circumferential surface. In the embodiment of the present invention, a plurality of such the choke tubes 1 are prepared in accordance with design ballistic patterns. The design ballistic patterns, determined in accordance with respective inner shapes of the choke tubes 1, can be identified visually when the choke tubes 1 are seen. For that purpose, the specific colors of the wear resistant coatings 4 are employed. Namely, in the embodiment, different colors are prepared for the inner shapes that define different design ballistic patterns. The wear resistant coatings 4 of the different colors are applied over the outer surfaces of the tube bodies 2 having the design ballistic patterns corresponding to the colors of the wear resistant coatings 4.

A wear resistant coating 4 is selected from a titanium nitride film (TiN film), a titanium carbide nitride film (TiCN film), a titanium oxide film ($TiO_2$ film) and a titanium aluminum nitride film (Tialvn film), which have specific colors that are different from each other. The titanium nitride film (TiN film) has a cold color. The titanium carbide nitride film (TiCN film) is champagne gold. The titanium oxide film ($TiO_2$ film) is blue. The titanium aluminum nitride film (Tialvn film) is brown. They develop bright colors (half tones), respectively. Application of the wear resistant coatings 4 of the specific colors related to the respective design ballistic patterns can increase commodity values of the choke tubes and achieve decorative effects.

The wear resistant coating 4, serving to enhance the wear resistance on the entire surface of the tube body 2 including the inner and outer circumferential surfaces, has such the color that indicates the design ballistic pattern of that tube body 2. Therefore, the design ballistic pattern can be easily identified when the choke tube 1 is seen. The wear resistant coating 4 itself is not modified by the heat and impact on firing and is fixed on the surface with stability. Accordingly, each choke tube 1 provides a stable indication of the design ballistic pattern thereof.

As shown, a cover ring 6 in a shape expanded outward is provided around the outer circumference of the tube body 2 at the discharge orifice 5. The choke tube 1 comprises the cover ring 6 and the tube body 2. The cover ring 6 is detachably attached to the tube body 2 at the discharge orifice 5 when it is screwed with a threaded portion 7 that is formed around the outer circumferential surface of the tube body 2.

As shown in FIG. 1, where the cover ring 6 is separated from the tube body 2, a plurality of flat planes 8 are arranged in parallel over the outer circumferential surface of the tube body 2 at the discharge orifice. The flat planes 8 arranged in parallel around the outer circumferential surface of the tube body 2 provide a diamond-cut, attachment-tool-graspable decorated portion 9 on the outer circumferential surface at the discharge orifice. A plurality of such the decorated portions 9 are arranged adjacent to each other in the longitudinal direction of the tube body 2. Adjacent decorated portions 9 are formed such that the flat planes 8 have a half-pitch shifted positional relation therebetween in the outer circumferential direction. In order to provide an excellent design property, such the diamond-cut decorated portions 9 are formed on the outer circumferential surface of the discharge orifice 5 at the tip, which is one of important locations that determine the design property of the choke tube 1. Further, the decorated portions 9 are arranged adjacent to each other and the positions of the flat planes 8 are half-pitch shifted to each other in the circumferential direction. This is extremely effective to improve the design property of the choke tube 1. The decorated portions 9 themselves are graspable with an attachment tool. Namely, the flat planes 8 are arranged in parallel and adjacent ones of the flat planes 8 arranged in the circumferential direction define an angled corner therebetween. Accordingly, a readily prepared household tool such as a spanner and a prier can grasp and turn the decorated portions 9 to attach and detach the choke tube 1 to and from the barrel, without the need for particularly preparing a special tool.

Between the decorated portions 9 and the threaded portion 7 on the tube body 2, a plurality of slits 10 elongated along the length of the tube body 2 are formed through the tube wall of the tube body 2, within a range not extended to the threaded portion 7 and the decorated portions 9, at an equal interval in the circumferential direction. The slits 10 each help the firing gas diffuse and escape to external around the tube body 2 on firing. The diffusion of the firing gas through the slits 10 dissipates the heat on firing and prevents the temperatures on the choke tube 1 and the barrel from elevating higher even after a number of pellets are discharged successively.

In the embodiment, a devise is applied to help the firing gas escape to the surrounding from the discharge orifice 5 of the tube body 2. As shown, four notched recesses 11 are formed in the tip around the discharge orifice 5 at an equal interval in the circumferential direction of the discharge orifice 5. As a result, the bore of the discharge orifice 5 is partially enlarged to help the firing gas escape to the surrounding from the recesses 11 located at the tip around the discharge orifice 5. This is effective to suppress the impact on firing. Preferably, the recesses 11 have a dimension of about 5 mm in the longitudinal direction of the tube body 2.

Figure 2:
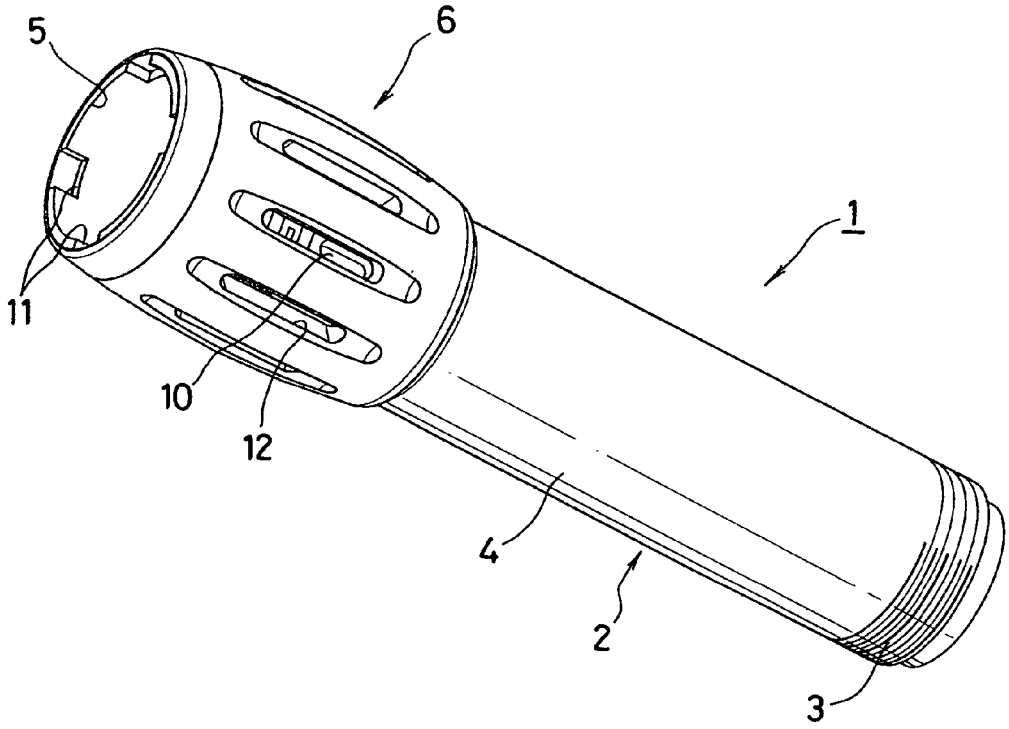
FIG. 2 is an illustrative view showing the same example.

The cover ring 6 is screwed with the threaded portion 7 of the tube body 2 in a setting for aligning the aperture at the tip of the cover ring 6 with the discharge orifice 5 as shown in FIG. 2. The cover ring 6 also has slits 12 formed through the tube wall of the cover ring 6 at the locations corresponding to the slits 10 when it is attached to the tube body 2. Therefore, the firing gas can pass through the slits 10 of the tube body 2 and through the slits 12 even after the cover ring 6 is attached. Thus, the effect on prevention of the temperature elevation at the tube body 2 is not lost. The cover ring 6 locates over the recesses 11 though the bore of the discharge orifice 5 is still partially widened. Thus, the effect on facilitation of diffusion of the firing gas is not lost. The cover ring 6 is employed to cover the decorated portions 9 that may be often damaged with the tool on attachment and detachment of the choke tube 1 to and from the barrel. Accordingly, the beauty of the shotgun can not be lost after the choke tube 1 is set.

What is claimed is:

1. A choke tube having a tube inner shape for defining a design ballistic pattern, comprising:

a tube body having a length, a wall, a circumference, an inner surface, an outer circumferential surface, and an end comprising a discharge orifice, the end having a tip, and said body being made of a high-hardness stainless steel;

a plurality of slits elongated along the length of the tube and formed through the tube body close to the discharge orifice and spaced at equal intervals around the circumference; and a wear resistant coating applied both on the outer surface of the tube body and on an inner surface of the discharge orifice, wherein the wear resistant coating over the inner surface of the discharge orifice is identical with the wear resistant coating applied on the outer surface of the tube body, wherein the wear resistant coating maintains a particular and bright color corresponding to the tube inner shape even after successive discharges to allow the design ballistic pattern to be identified by the outward appearance of the choke tube, and wherein said coating is selected from the group consisting of a titanium nitride film, a titanium carbide nitride film, a titanium oxide film and a titanium aluminum nitride film.

2. The choke tube according to claim 1, further comprising a decorated portion formed around the outer circumferential surface of the tube body, wherein a plurality of diamond-cut flat planes are arranged in parallel on the decorated portion to allow an attachment tool to grasp the decorated portion.

3. The choke tube according to claim 1, further comprising a plurality of notched recesses formed in the tip around the discharge orifice of the tube body at an equal interval in the circumferential direction.

4. The choke tube according to claim 2, further comprising a plurality of notched recesses formed in the tip around the discharge orifice of the tube body at an equal interval in the circumferential direction.

5. The choke tube according to claim 1, wherein the high-hardness stainless steel comprises up to 0.07% carbon, up to 1% silicon, up to 1% manganese, up to 0.04% phosphorus, up to 0.03% sulfur, from 3% to 5% nickel, from 15% to 17.5% chromium, from 3% to 5% copper and from 0.15% to 0.45% niobium.

6. The choke tube according to claim 1, wherein the stainless steel has been processed at 1050 degrees Celsius into a solid solution and thereafter subjected to further hardening at 510 degrees in vacuum for five hours.

7. The choke tube according to claim 1, wherein an inner circumferential surface of the tube is finished to have a surface roughness S less than or equal to 3.2.

8. The choke tube according to claim 1, wherein an inner diameter dimensional accuracy comprises roundness within a tolerance of less than or equal to 0.03.

9. The choke tube according to claim 1, wherein the coating comprises a titanium oxide film and at least one of a titanium nitride film, a titanium carbide nitride film, and a titanium aluminum nitride film.

10. The choke tube according to claim 1, wherein the coating consists of a titanium oxide film.

11. The choke tube according to claim 3, wherein the notched recesses extend completely through the wall.

12. The choke tube according to claim 1, wherein the color corresponds to the design ballistic pattern defined by the tube inner shape.

* * * * *